US009410386B2

(12) United States Patent
Hemmings et al.

(10) Patent No.: US 9,410,386 B2
(45) Date of Patent: Aug. 9, 2016

(54) PROCESS FOR CONVERSION OF INTRACTABLE OIL-BEARING, DRILL CUTTING WASTES FROM DEEP GAS EXPLORATION WELLS TO ENGINEERING CONSTRUCTION MATERIALS

(71) Applicants: Raymond T. Hemmings, Kennesaw, GA (US); Bruce J. Cornelius, Waterdown (CA)

(72) Inventors: Raymond T. Hemmings, Kennesaw, GA (US); Bruce J. Cornelius, Waterdown (CA)

(73) Assignee: MARYLAND ENVIRONMENTAL RESTORATION GROUP, INC., Williamsport, MD (US)

( * ) Notice: Subject to any disclaimer, the term of this patent is extended or adjusted under 35 U.S.C. 154(b) by 86 days.

(21) Appl. No.: 14/023,811

(22) Filed: Sep. 11, 2013

(65) Prior Publication Data

US 2014/0072368 A1 Mar. 13, 2014

Related U.S. Application Data

(60) Provisional application No. 61/699,411, filed on Sep. 11, 2012.

(51) Int. Cl.
*E21B 21/06* (2006.01)
*E01C 3/00* (2006.01)

(52) U.S. Cl.
CPC ..... *E21B 21/065* (2013.01); *E01C 3/003* (2013.01); *E21B 21/066* (2013.01)

(58) Field of Classification Search
CPC ..... E21B 21/065; E01C 3/003
See application file for complete search history.

(56) References Cited

U.S. PATENT DOCUMENTS

| | | | | |
|---|---|---|---|---|
| 6,322,489 | B1 * | 11/2001 | Richardson et al. | 588/252 |
| 6,706,108 | B2 * | 3/2004 | Polston | 106/285 |
| 7,118,624 | B2 * | 10/2006 | Polston | 106/697 |
| 7,371,277 | B2 * | 5/2008 | Polston | 106/697 |
| 8,007,581 | B2 * | 8/2011 | Scott et al. | 106/277 |
| 2003/0116887 | A1 * | 6/2003 | Scott | 264/333 |
| 2012/0090509 | A1 * | 4/2012 | Albert | 106/792 |
| 2012/0271091 | A1 * | 10/2012 | Manno et al. | 588/257 |

* cited by examiner

*Primary Examiner* — Paul Marcantoni
(74) *Attorney, Agent, or Firm* — Clark Hill PLC; John S. Paniaguas

(57) ABSTRACT

A process is disclosed which converts intractable, semi-solid drill cuttings into a free-flowing granular, soil-like SDC material, which, after appropriate compaction, can be beneficially used for a variety of engineering construction applications, thereby removing the need for disposal with its associated costs and environmental impact, and as a result improving the overall economics for gas well development, together with improving corporate sustainability and reducing liability.

12 Claims, 18 Drawing Sheets

| Materials | lb/ft3 |
|---|---|
| Drill cuttings, raw | 35-45 |
| Drill cuttings, treated | 79 |
| Concrete | 145 |
| Sand, fine | 125 |
| Cement | 94 |
| Soil, clay to sandy | 68-100 |
| Limestone, fine | 63-69 |
| Clay | 50-60 |
| Gypsum, ground | 42 |
| Talc | 35-55 |
| Coal dust | 35 |

LS-706 Moisture Density Curve Calculation

Project No. TB82102 Project Name: MERG Date July 17/12

Ref. No. _____ Item No. and Description Shale cuttings

| Wt. of compacted sample and 1/30 ft³ container [1] g | Wt. of 2.13g/cm³ mold [2] g | Wt. of sample [3] g | Wet density of sample [4] g/cm³ | Moisture Content Determination: Dish No. [5] | Wet wt. & dish [6] g | Dry wt. & dish [7] g | Wt. of water [8] g | Wt. of dish [9] g | Wt. of dry sample [10] g | Moisture content [11] % | Dry density of sample [12] lb/ft³ |
|---|---|---|---|---|---|---|---|---|---|---|---|
| 5613 | 4688 | 1825 | 1834 | 1 | 29.2 | 26.9 | 2 | 1.3 | 26 | 9.0 | 110.76 |
| 5557 | 4688 | 1870 | 1981 | 2 | 39.2 | 35.9 | 3 | 1.3 | 35 | 9.5 | 112.89 |
| 5588 | 4688 | 1900 | 2013 | 3 | 40.2 | 36.5 | 4 | 1.3 | 35 | 10.5 | 113.70 |
| 5613 | 4688 | 1926 | 2040 | 4 | 34.1 | 30.7 | 3 | 1.3 | 29 | 11.6 | 114.14 |
| 5608 | 4688 | 1921 | 2095 | 5 | 37.8 | 33.5 | 4 | 1.3 | 32 | 13.4 | 112.05 |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |

Remarks:

Maximum dry density, g/cm³ _____

Optimum moisture content, % _____

Curve 2.5

Equations

[3] Weight of sample — [1] − [2] = [3]
[4] Wet density of sample — [3] × 2.13 = [4]
[8] Weight of water — [6] − [7] = [8]
[10] Weight of dry sample — [7] − [9] = [10]
[11] Moisture content — [8] ÷ [10] × 100 = [11]
[12] Dry density of sample — [4] ÷ (1 + [11] ÷ 100) = [12]

Units kg — kilograms
kgm³ — kilogram per cubic metre
g — grams

Inspector _____ Date _____

LS-706 Moisture Density Curve Calculation (back)

Maximum Dry Density
Optimum Moisture Content
As Received Moisture

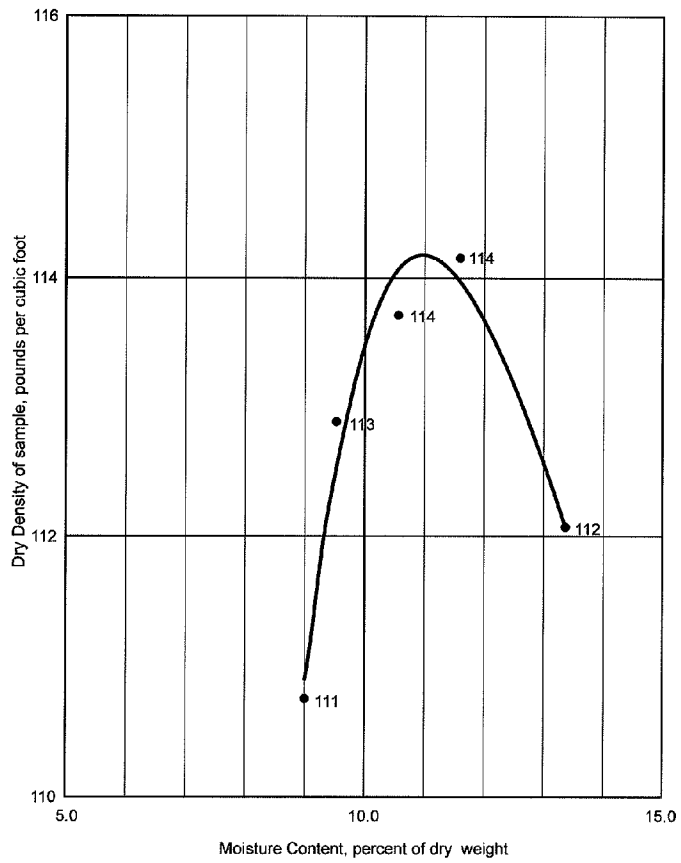

For Zero Air Voids Curve, Specific Gravity, Gs = 2.67

Figure 10a 10% SERRG Reagent

LS-706 Moisture Density Curve Calculation

Project No. *TB82102* Project Name: *MERG* Date *July 17/12*

Ref. No. _____ Item No. and Description *Shale cuttings*

| Wt. of compacted sample and 1/30 ft³ container [1] g | Wt. of 2.13g/cm³ mold [2] g | Wt. of sample [3] g | Wet density of sample [4] g/cm³ | Moisture Content Determination: Dish No. [5] | Wet wt. & dish [6] g | Dry wt. & dish [7] g | Wt. of water [8] g | Wt. of dish [9] g | Wt. of dry sample [10] g | Moisture content [11] % | Dry density of sample [12] lb/ft³ |
|---|---|---|---|---|---|---|---|---|---|---|---|
| 5542 | 4688 | 1854 | 1834 | 1 | 45.9 | 42.4 | 4 | 1.3 | 41 | 8.5 | 113.01 |
| 5587 | 4688 | 1893 | 2012 | 2 | 34.3 | 31.3 | 3 | 1.3 | 30 | 10.0 | 114.17 |
| 5619 | 4688 | 1831 | 2046 | 3 | 41.8 | 37.4 | 4 | 1.3 | 36 | 12.2 | 113.83 |
| 5606 | 4688 | 1918 | 2032 | 4 | 36.6 | 32.2 | 4 | 1.3 | 31 | 14.2 | 111.03 |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |

Remarks:

Maximum dry density, g/cm³ _____

Optimum moisture content, % _____

Curve *2.5*

Equations

| | |
|---|---|
| [3] Weight of sample | [1] − [2] = [3] |
| [4] Wet density of sample | [3] × 2.13 = [4] |
| [8] Weight of water | [6] − [7] = [8] |
| [10] Weight of dry sample | [7] − [9] = [10] |
| [11] Moisture content | [8] ÷ [10] × 100 = [11] |
| [12] Dry density of sample | [4] ÷ (1 + [11] ÷ 100) = [12] |

Units kg — kilograms kgm³ — kilogram per cubic metre g — grams

Inspector _____ Date _____

LS-706 Moisture Density Curve Calculation (back)

Maximum Dry Density
Optimum Moisture Content
As Received Moisture

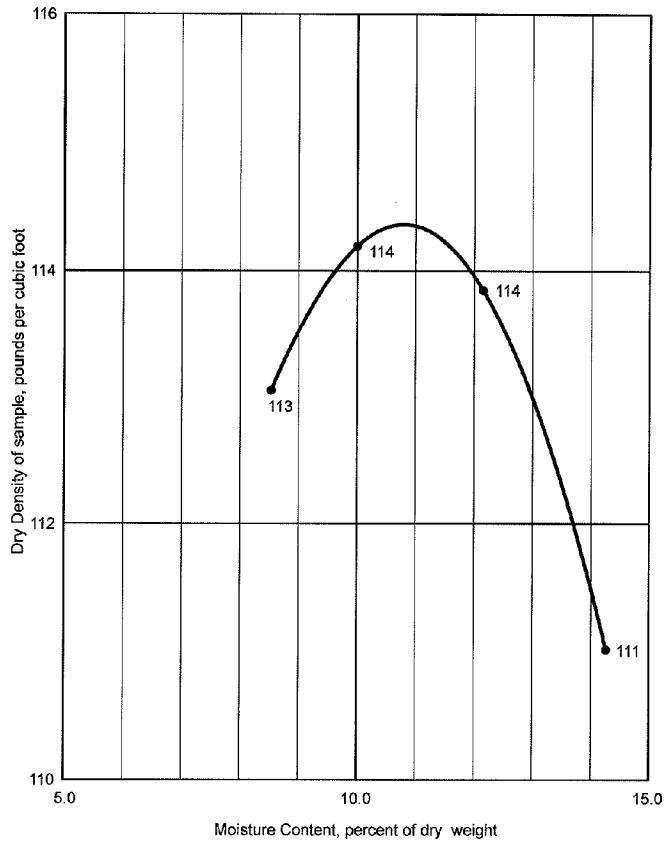

For Zero Air Voids Curve, Specific Gravity, Gs = *2.67*

Figure 10b 15% SERRG Reagent

LS-706 Moisture Density Curve Calculation

Project No. TB82102 Project Name: MERG Date July 18/12

Ref. No. _____ Item No. and Description Shale cuttings

| Wt. of compacted sample and 1/30 ft³ container [1] g | Wt. of 2.13g/cm³ mold [2] g | Wt. of sample [3] g | Wet density of sample [4] g/cm³ | Moisture Content Determination: Dish No. [5] | Wet wt. & dish [6] g | Dry wt. & dish [7] g | Wt. of water [8] g | Wt. of dish [9] g | Wt. of dry sample [10] g | Moisture content [11] % | Dry density of sample [12] lb/ft³ |
|---|---|---|---|---|---|---|---|---|---|---|---|
| 5455 | 4688 | 1797 | 1904 | 1 | 38.4 | 35.4 | 3 | 1.3 | 34 | 8.8 | 109.25 |
| 5537 | 4688 | 1849 | 1958 | 2 | 37.4 | 34.1 | 3 | 1.3 | 33 | 10.1 | 111.09 |
| 5572 | 4688 | 1885 | 1996 | 3 | 33.4 | 29.9 | 4 | 1.3 | 29 | 12.2 | 111.04 |
| 5582 | 4688 | 1984 | 2006 | 4 | 43.3 | 38.9 | 5 | 1.3 | 37 | 13.5 | 110.34 |
| 5548 | 4688 | 1862 | 1972 | 5 | 32.2 | 28.9 | 4 | 1.3 | 27 | 15.3 | 106.78 |
| 5525 | 4688 | 1898 | 1947 | 6 | 35.6 | 30.7 | 5 | 1.3 | 29 | 16.7 | 104.16 |
| 5494.7 | 4688 | 1807.1 | 1914.301 | 7 | 29.80 | 25.40 | 4 | 1.30 | 24 | 18.3 | 101.06 |
| | | | | | | | | | | | |
| | | | | | | | | | | | |
| | | | | | | | | | | | |
| | | | | | | | | | | | |
| | | | | | | | | | | | |
| | | | | | | | | | | | |

Remarks:

Maximum dry density, g/cm³ _____

Optimum moisture content, % _____

Curve 2.5

Equations

[3] Weight of sample [1] − [2] = [3]
[4] Wet density of sample [3] × 2.13 = [4]
[8] Weight of water [6] − [7] = [8]
[10] Weight of dry sample [7] − [9] = [10]
[11] Moisture content [8] ÷ [10] × 100 = [11]
[12] Dry density of sample [4] ÷ (1 + [11] ÷ 100) = [12]

Units kg — kilograms
kgm³ — kilogram per cubic metre
g — grams

Inspector Date

LS-706 Moisture Density Curve Calculation (back)

Maximum Dry Density
Optimum Moisture Content
As Received Moisture

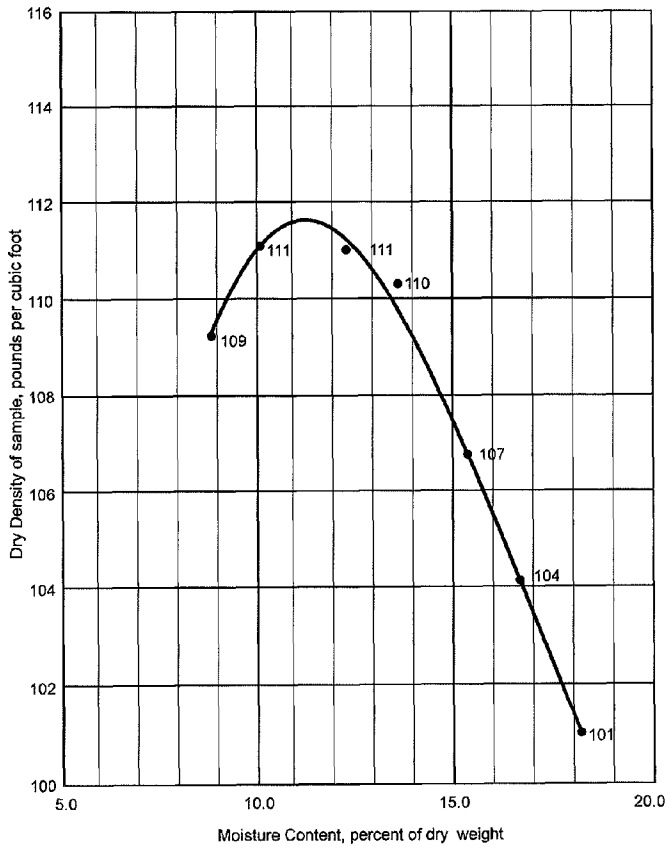

For Zero Air Voids Curve, Specific Gravity, Gs = 2.67

Figure 10c 20% SERRG Reagent

LS-706 Moisture Density Curve Calculation

Project No. TB82102 Project Name: MERG Date July 17/12

Ref. No. _____ Item No. and Description Shale cuttings

| Wt. of compacted sample and 1/30 ft³ container [1] g | Wt. of 2.13g/cm³ mold [2] g | Wt. of sample [3] g | Wet density of sample [4] g/cm³ | Moisture Content Determination: Dish No. [5] | Wet wt. & dish [6] g | Dry wt. & dish [7] g | Wt. of water [8] g | Wt. of dish [9] g | Wt. of dry sample [10] g | Moisture content [11] % | Dry density of sample [12] lb/ft³ |
|---|---|---|---|---|---|---|---|---|---|---|---|
| 5424 | 4688 | 1737 | 1840 | 1 | 38.6 | 37.1 | 3 | 1.3 | 36 | 7.0 | 107.35 |
| 5478 | 4688 | 1790 | 1896 | 2 | 40.3 | 37.0 | 3 | 1.3 | 36 | 9.2 | 108.35 |
| 5524 | 4688 | 1837 | 1946 | 3 | 33.2 | 30.0 | 3 | 1.3 | 29 | 11.1 | 109.28 |
| 5562 | 4688 | 1874 | 1985 | 4 | 38.0 | 33.9 | 4 | 1.3 | 33 | 12.6 | 110.09 |
| 5583 | 4688 | 1895 | 2007 | 5 | 29.3 | 26.9 | 3 | 1.3 | 25 | 13.8 | 110.10 |
| 5567 | 4688 | 1880 | 1997 | 6 | 35.9 | 31.1 | 5 | 1.3 | 30 | 16.1 | 107.06 |
| 5445.3 | 4688 | 1857.7 | 1968 | 7 | 32.00 | 27.20 | 5 | 1.30 | 26 | 18.5 | 103.64 |
| | | | | | | | | | | | |
| | | | | | | | | | | | |
| | | | | | | | | | | | |
| | | | | | | | | | | | |
| | | | | | | | | | | | |
| | | | | | | | | | | | |

Remarks:

Maximum dry density, g/cm³ _____

Optimum moisture content, % _____

Curve 2.5

Equations

| | |
|---|---|
| [3] Weight of sample | [1] − [2] = [3] |
| [4] Wet density of sample | [3] × 2.13 = [4] |
| [8] Weight of water | [6] − [7] = [8] |
| [10] Weight of dry sample | [7] − [9] = [10] |
| [11] Moisture content | [8] ÷ [10] × 100 = [11] |
| [12] Dry density of sample | [4] ÷ (1 + [11] ÷ 100) = [12] |

Units kg — kilograms
kgm³ — kilogram per cubic metre
g — grams

Inspector _____ Date _____

LS-706 Moisture Density Curve Calculation (back)

Maximum Dry Density
Optimum Moisture Content
As Received Moisture

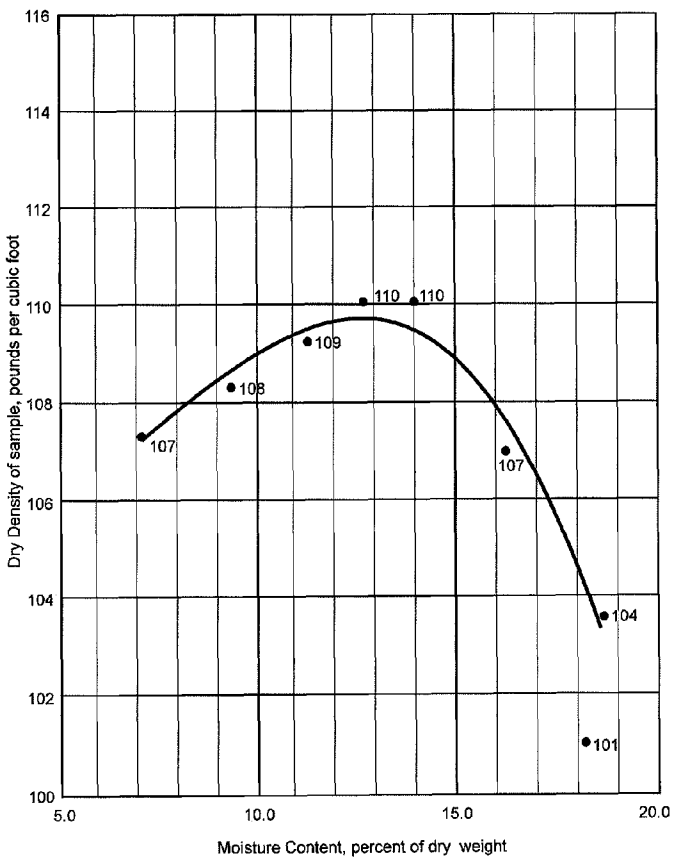

For Zero Air Voids Curve, Specific Gravity, Gs = 2.67

Figure 10d 25% SERRG Reagent

LS-706 Moisture Density Curve Calculation

Project No. TB82102 Project Name: MERG Date August 10/12

Ref. No. _____ Item No. and Description 30% Binder Shale cuttings

| Wt. of compacted sample and 1/30 ft³ container [1] g | Wt. of 2.13g/cm³ mold [2] g | Wt. of sample [3] g | Wet density of sample [4] g/cm³ | Moisture Content Determination: Dish No. [5] | Wet wt. & dish [6] g | Dry wt. & dish [7] g | Wt. of water [8] g | Wt. of dish [9] g | Wt. of dry sample [10] g | Moisture content [11] % | Dry density of sample [12] lb/ft³ |
|---|---|---|---|---|---|---|---|---|---|---|---|
| 6070 | 4395 | 1675 | 1774 | 1 | 189.8 | 181.5 | 8 | 76.1 | 105 | 7.9 | 102.68 |
| 6115 | 4395 | 1720 | 1822 | 2 | 144.8 | 137.7 | 7 | 63.4 | 74 | 9.5 | 103.82 |
| 6176 | 4395 | 1781 | 1887 | 3 | 210.3 | 196.7 | 14 | 72.6 | 124 | 11.0 | 106.15 |
| 6244 | 4395 | 1849 | 1950 | 4 | 421.2 | 404.9 | 18 | 277.9 | 127 | 12.8 | 108.37 |
| 6290 | 4395 | 1895 | 2007 | 5 | 444.2 | 422.0 | 22 | 279.8 | 142 | 15.6 | 108.40 |
| 6251 | 4395 | 1856 | 1966 | 6 | 446.9 | 418.7 | 26 | 278.4 | 141 | 18.5 | 103.54 |
| 6177 | 4395 | 1782 | 1898 | 7 | 431.2 | 406.8 | 24 | 293.6 | 113 | 21.6 | 96.95 |
| | | | | | | | | | | | |
| | | | | | | | | | | | |
| | | | | | | | | | | | |
| | | | | | | | | | | | |
| | | | | | | | | | | | |
| | | | | | | | | | | | |

Remarks:

Maximum dry density, g/cm³ _____

Optimum moisture content, % _____

Curve 2.5

Equations

[3] Weight of sample [1] − [2] = [3]
[4] Wet density of sample [3] × 2.13 = [4]
[8] Weight of water [6] − [7] = [8]
[10] Weight of dry sample [7] − [9] = [10]
[11] Moisture content [8] ÷ [10] × 100 = [11]
[12] Dry density of sample [4] ÷ (1 + [11] ÷ 100) = [12]

Units kg — kilograms
kgm³ — kilogram per cubic metre
g — grams

Inspector _____ Date _____

LS-706 Moisture Density Curve Calculation (back)

Maximum Dry Density
Optimum Moisture Content
As Received Moisture

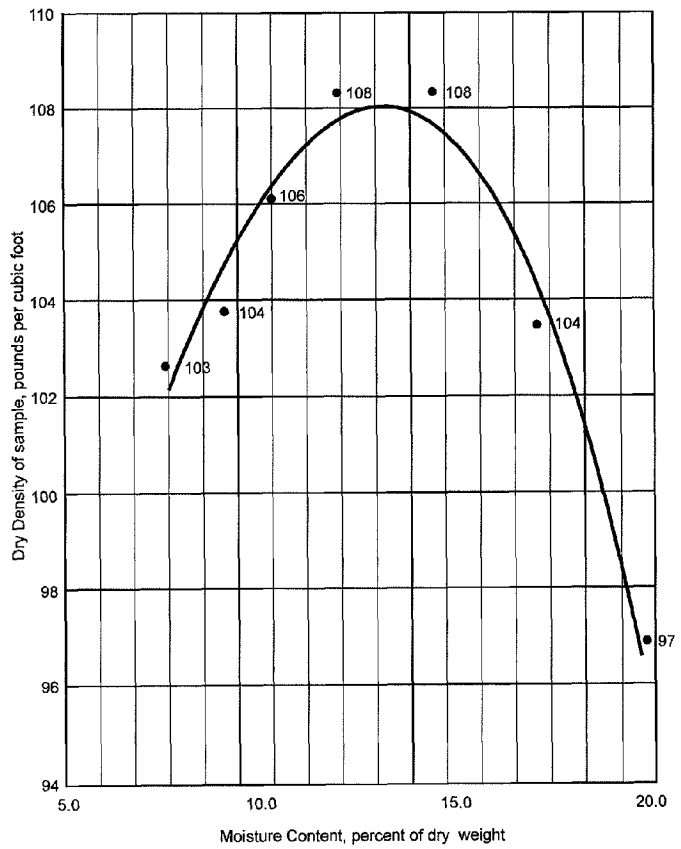

For Zero Air Voids Curve, Specific Gravity, Gs = 2.67

Figure 10e 30% SERRG Reagent

Laboratory Sample ID: 2F28054-01 (Solid/Grab)

| Analyte | Result | MDL | RL | Units | Date / Time Analyzed | Method | Analyst | Note |
|---|---|---|---|---|---|---|---|---|
| **TCLP Metals by 6000/7000 Series Methods** | | | | | | | | |
| Silver | <0.0200 | | 0.0200 | mg/l | 07/05/12 12:18 | EPA 6010B/2.0 | rab | |
| Arsenic | <0.0200 | | 0.0200 | mg/l | 07/05/12 12:19 | EPA 6010B/2.0 | rab | |
| **Barium** | 0.0580 | | 0.0500 | mg/l | 07/05/12 12:19 | EPA 6010B/2.0 | rab | |
| Cadmium | <0.0100 | | 0.0100 | mg/l | 07/05/12 12:19 | EPA 6010B/2.0 | rab | |
| **Chromium** | 0.0162 | | 0.00500 | mg/l | 07/05/12 12:19 | EPA 6010B/2.0 | rab | |
| Mercury | <0.000200 | | 0.000200 | mg/l | 07/05/12 09:49 | EPA 7471B | jg | |
| Lead | <0.0100 | | 0.0100 | mg/l | 07/05/12 12:19 | EPA 6010B/2.0 | rab | |
| Selenium | <0.0500 | | 0.0500 | mg/l | 07/05/12 12:19 | EPA 6010B/2.0 | rab | |
| **TCLP Semivolatile Organic Compounds by EPA Method 8270** | | | | | | | | |
| Pyridine | <100 | | 100 | µg/l | 07/06/12 13:28 | EPA 8270D | RSR | QD |
| 1,4-Dichlorobenzene | <50.0 | | 50.0 | µg/l | 07/06/12 13:28 | EPA 8270D | RSR | |
| 2,4-Dinitrotoluene | <50.0 | | 50.0 | µg/l | 07/06/12 13:28 | EPA 8270D | RSR | |
| 3 & 4-Methylphenol | <100 | | 100 | µg/l | 07/06/12 13:28 | EPA 8270D | RSR | |
| Hexachlorobenzene | <50.0 | | 50.0 | µg/l | 07/06/12 13:28 | EPA 8270D | RSR | |
| **TCLP Semivolatile Organic Compounds by EPA Method 8270** | | | | | | | | |
| Hexachlorobutadiene | <50.0 | | 50.0 | µg/l | 07/06/12 13:28 | EPA 8270D | RSR | |
| Hexachloroethane | <50.0 | | 50.0 | µg/l | 07/06/12 13:28 | EPA 8270D | RSR | |
| 2-Methylphenol | <50.0 | | 50.0 | µg/l | 07/06/12 13:28 | EPA 8270D | RSR | |
| Nitrobenzene | <50.0 | | 50.0 | µg/l | 07/06/12 13:28 | EPA 8270D | RSR | |
| Pentachlorophenol | <250 | | 250 | µg/l | 07/06/12 13:28 | EPA 8270D | RSR | |
| 2.4.5-Trichlorophenol | <50.0 | | 50.0 | µg/l | 07/06/12 13:28 | EPA 8270D | RSR | |
| 2.4.6-Trichlorophenol | <50.0 | | 50.0 | µg/l | 07/06/12 13:28 | EPA 8270D | RSR | |
| *Surrogate: 2-Fluorophenol* | | *59.0%* | *35-115* | | *07/06/12 13:28* | *EPA 8270D* | RSR | |
| *Surrogate: Phenol-d6* | | *37.2%* | *35-115* | | *07/06/12 13:28* | *EPA 8270D* | RSR | |
| *Surrogate: Nitrobenzene-d5* | | *76.8%* | *35-115* | | *07/06/12 13:28* | *EPA 8270D* | RSR | |
| *Surrogate: 2-Fluorobiphenol* | | *80.3%* | *40-120* | | *07/06/12 13:28* | *EPA 8270D* | RSR | |
| *Surrogate:2.4.6 Tribomophenol* | | *80.8%* | *40-120* | | *07/06/12 13:28* | *EPA 8270D* | RSR | |
| *Surrogate: Terphenol-d14* | | *96.4%* | *40-120* | | *07/06/12 13:28* | *EPA 8270D* | RSR | |
| **TCLP Volatile Organic Compounds by EPA Method 1311/8260B** | | | | | | | | |
| Benzene | <50.0 | | 50.0 | µg/l | 07/06/12 23:00 | EPA 8260B | wlm | |
| 2-Butanone | <500 | | 50.0 | µg/l | 07/06/12 23:00 | EPA 8260B | wlm | |
| Caron tetrachloride | <50.0 | | 50.0 | µg/l | 07/06/12 23:00 | EPA 8260B | wlm | |
| Chlorobenzene | <50.0 | | 50.0 | µg/l | 07/06/12 23:00 | EPA 8260B | wlm | |
| Chloroform | <50.0 | | 50.0 | µg/l | 07/06/12 23:00 | EPA 8260B | wlm | |

Table 15 (contd)...

Figure 15

. . .Table 15 (contd.)

| | | | | | | |
|---|---|---|---|---|---|---|
| **TCLP Volatile Organic Compounds by EPA Method 1311/8260B** | | | | | | |
| 1.4-Dichlorobenzene | <50.0 | 50.0 | µg/l | 07/06/12 23:00 | EPA 8260B | wlm |
| 1.2-Dichloroethane | <50.0 | 50.0 | µg/l | 07/06/12 23:00 | EPA 8260B | wlm |
| 1.1-Dichloroethene | <50.0 | 50.0 | µg/l | 07/06/12 23:00 | EPA 8260B | wlm |
| Tetrachloroethene | <50.0 | 50.0 | µg/l | 07/06/12 23:00 | EPA 8260B | wlm |
| Trachloroethene | <50.0 | 50.0 | µg/l | 07/06/12 23:00 | EPA 8260B | wlm |
| Vinyl chloride | <50.0 | 50.0 | µg/l | 07/06/12 23:00 | EPA 8260B | wlm |
| *Surrogate: 2-Bromofluorohenzene* | *99.0%* | *70-130* | | *07/06/12 23:00* | *EPA 8260B* | wlm |
| *Surrogate: 1.2-Dichloroethane-d4* | *108%* | *70-130* | | *07/06/12 23:00* | *EPA 8260B* | wlm |
| *Surrogate: Fluorobenzene* | *81.2%* | *70-130* | | *07/06/12 23:00* | *EPA 8260B* | wlm |
| **Conventional Chemistry Parameters by SM/EPA Methods** | | | | | | |
| % Solids | 83.4 | 0.100 | % | 06/29/12 17:43 | SM20-2540G | rph |
| **TCLP Extraction by EPA 1311** | | | | | | |
| pH @ 21.8°C | 11.5 | | pH Units | 07/03/12 15:10 | EPA 1311 | clb |

Figure 15

PROCESS FOR CONVERSION OF INTRACTABLE OIL-BEARING, DRILL CUTTING WASTES FROM DEEP GAS EXPLORATION WELLS TO ENGINEERING CONSTRUCTION MATERIALS

CROSS REFERENCE TO RELATED APPLICATIONS

This application claims priority to and claims the benefit of U.S. Provisional Patent Application No. 61/699,411, filed on Sep. 11, 2012, hereby incorporated by reference.

BACKGROUND OF THE INVENTION

1. Field of the Invention

The present invention relates to a process and associated treatment reagents for use in the natural gas exploration industry, and more specifically to a means for converting intractable, semi-solid, drill cutting wastes from gas well development to granular, free-flowing Stabilized Drill Cuttings, termed "SDC material," which is an environmentally compliant product that can be used, in compacted form, for many beneficial applications in engineering construction as a replacement for naturally occurring mined and/or quarried minerals.

2. Description of the Prior Art

Exploration wells to recover natural gas from deep deposits of black shale throughout Appalachia (Marcellus, Utica, etc), Colorado, Utah, Wyoming, Texas, etc., are a major new source of clean energy for the US economy, with enormous growth being projected over the next ten years.

As a by-product of the gas exploration process, approximately 10,000 tons, or more, of intractable drill cuttings may be produced as semi-solid, mud-like wastes (FIG. 1) from one exploration site alone. When hundreds, or thousands, of such exploration sites are considered, this represents a huge volume of waste material which must be managed in an environmentally sound manner.

The drill cuttings are considered by regulatory authorities as waste, which requires their disposal in controlled, engineered landfills at substantial costs to the industry, both in trucking costs and disposal (tipping) fees. Prior to such disposal, the semi-solid, wet drill cuttings must also first be dried/dewatered to the extent that they pass the EPA Method 0905B Paint Filter Liquids Test. This treatment, typically conducted by adding quicklime (CaO) to the wet drill cuttings, must be conducted at the well development site prior to trucking to the disposal site.

Drill cuttings from gas well exploration are typically extremely fine grained, where 90% or more of the material is finer than 50 mesh or 300 μm (FIGS. 2 & 3). Two distinct types of cuttings are produced from a single gas well: vertical cuttings and horizontal cuttings. The vertical cuttings vary from location to location and are typically comprised of a wide range of rock and mineral types including limestone, dolomite, and sandstone, The horizontal cuttings are typically comprised of gas-bearing shale inter-bedded with other mineral/rock types including quartz, calcite, dolomite, muscovite, and anorthite (FIG. 4). The vertical cuttings are largely produced with water as the drilling lubricant. The horizontal cuttings, which constitute by far the majority of the drill cuttings from a given site, typically contain, in addition to water, various oils and other additives used for lubrication and rheological control. Both forms of cuttings are produced and brought to the surface with high moisture content, typically in the range 10% to more than 45%, as an intractable, semi-solid, mud-like material which is very difficult to handle.

It will be appreciated that, overall, the management of the drill cuttings has a significant negative impact on the gas exploration industry, not only on the economics of operations, but also on the environmental sustainability. As noted above, the current practice by the industry is to treat the intractable drill cuttings with a drying agent, such as quicklime, to pass the EPA Paint Filter test. The treated drill cuttings are then trucked off-site for disposal at a landfill, which may be a considerable distance from the exploration site. This practice creates considerable pressure on the capacities of landfills in the region, together with the associated heavy truck traffic on local roads. In addition, the quicklime used for the drying process has a substantial carbon footprint, in that approximately one ton of the greenhouse gas carbon dioxide is released during the manufacture of one ton of lime. This means that for a single exploration site alone which produces 10,000 tons of drill cuttings during the well development phase, the lime treatment releases the equivalent of approximately 2,000-3,000 tons of carbon dioxide to the atmosphere. To improve the sustainability of the gas exploration process, it is therefore highly desirable that means be developed to beneficially use the waste drill cuttings and thereby reduce or preferably eliminate the need for disposal, together with the associated environmental and economic penalties.

In order to solve this problem, a process has been developed as disclosed in U.S. Pat. No. 8,007,581 in which drill cuttings are mixed with various binders in order to form material for use in drilling pads and vehicle roadways at alternate drill sites normally 5-10 miles away. In such an application, the drill cuttings are processed on the current drill site and transported to the new drill site.

Depending on the existence and types of aquifers at the location of the drill site, the water content of the drill cuttings can vary between 10% and 80%. Since the material strength of the material is a function of the ratio of the water to binder content, the amount of binder to be added to the drill cuttings varies as a function of the water content. As such, the cost for forming the drill cutting into a useable construction material is unstable and can vary substantially. In addition. construction materials formed from drill cuttings with a relatively high water content are relatively expensive to store and transport. These costs can approach the cost of transporting and dumping untreated drill cuttings to a landfill.

Another problem with known technology, such as disclosed in the '581 patent, relates to the process for forming a load bearing structure. The '581 patent teaches a process of adding a sufficient amount of pozzolanic binder or asphalt to the drill cuttings to form a cementitious mixture in order to form a load bearing structure. Unfortunately, using the drill cuttings as an aggregate to a pozzolanic binder or asphalt requires that the load bearing structures be formed at another drilling site prior to the completion of the drilling at the existing drill site. This process is somewhat cumbersome and further adds to the cost of using the drill cuttings for an engineering construction application which further drives the cost toward the cost of disposal of such drill cuttings.

Thus, there is need for utilizing the drill cuttings for useful construction applications, such as drill pads and roadways with relatively stable costs.

SUMMARY OF THE INVENTION

The present invention disclosed herein provides a means to address these significant problem issues through the use of process technology which converts the intractable, semi-solid drill cuttings into a free-flowing granular, soil-like SDC material, which, after appropriate compaction, can be beneficially used for a variety of engineering construction applications, thereby removing the need for disposal with its associated costs and environmental impact, and as a result improving the overall economics for gas well development, together with improving corporate sustainability. In accordance with an important aspect of the invention, the strength as well as the cost of forming a material suitable for use in engineering construction applications is stabilized resulting in a construction material with controlled cost. In accordance with another important aspect of the invention, the drill cuttings processed in accordance with the present invention can be used as an underlayment and compacted and topped off with a layer of sand and gravel to form a load bearing surface. In this way, the load bearing material need not be formed at an alternate drilling site.

BRIEF DESCRIPTION OF DRAWINGS

These and other benefits of the present invention will be readily understood with reference to the following specification and attached drawing wherein:

FIGS. 10(*a*)-(*e*). Typical Proctor moisture-density curves showing optimum moisture contents for SDC Material with different Reagent contents in the range 10% to 30% Reagent.

FIG. 15. EPA Method 1311: Toxicity Characteristic Leaching Procedure (TCLP), results for drill cuttings (20% moisture) stabilized with 20% reagent.

DESCRIPTION

Figure 1:
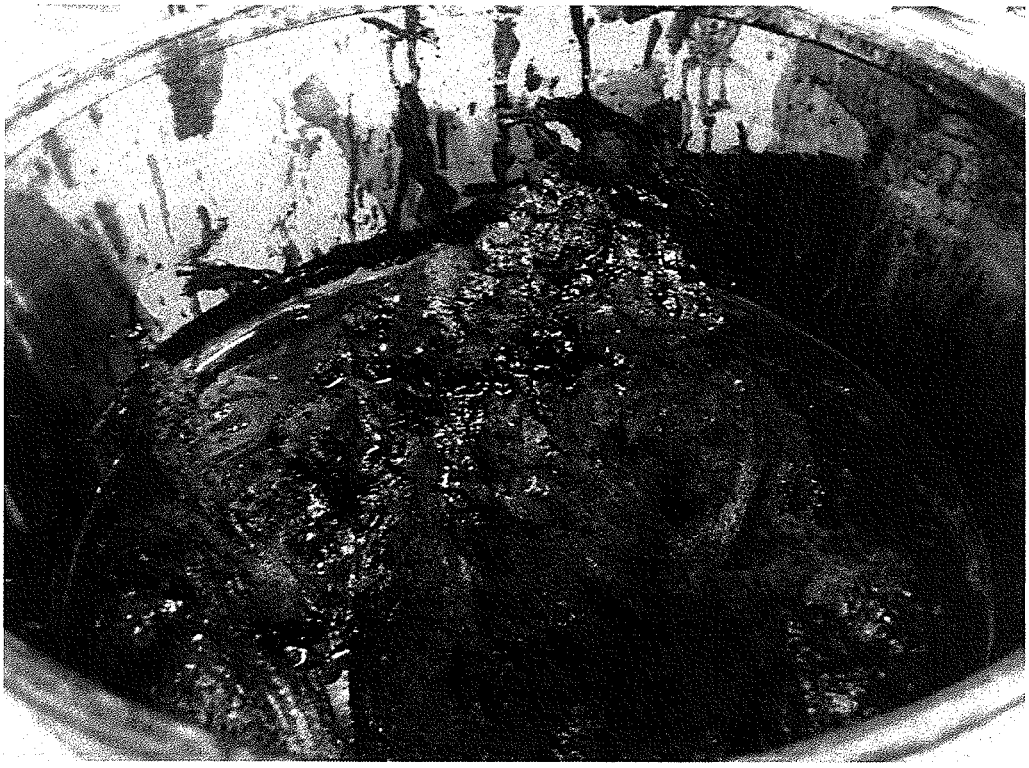
FIG. 1. Photograph of typical intractable horizontal drill cuttings with approximately 20% moisture content.
Figure 2:
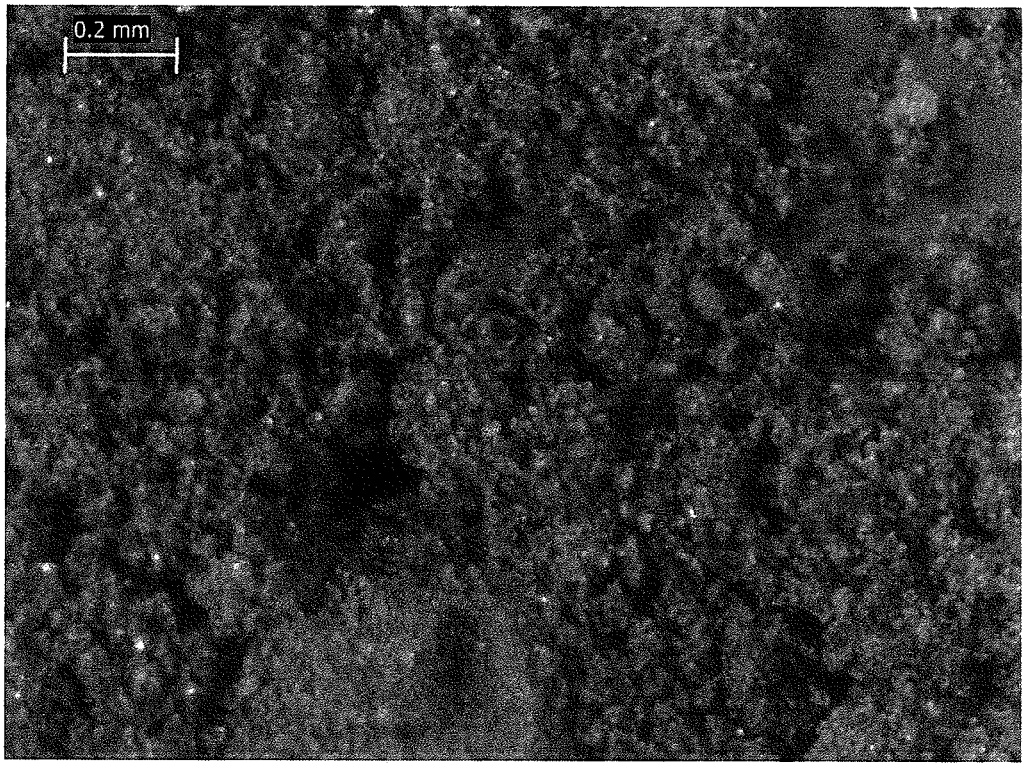
FIG. 2. Optical photomicrograph of dried horizontal drill cuttings (scale bar is 0.2 mm).
Figure 3:
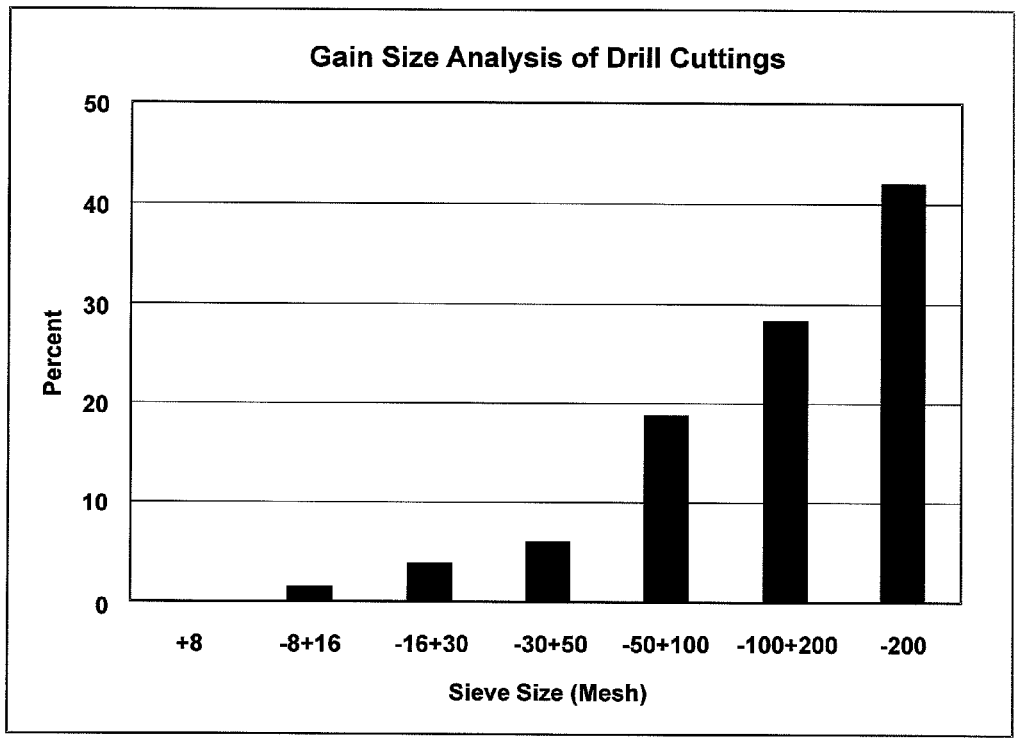
FIG. 3. Grain size distribution (mass percent vs. sieve size) of horizontal drill cuttings, showing that 90% of the material is finer than 50 mesh (300 μm). This is an extremely fine grained silty mud.
Figure 4:
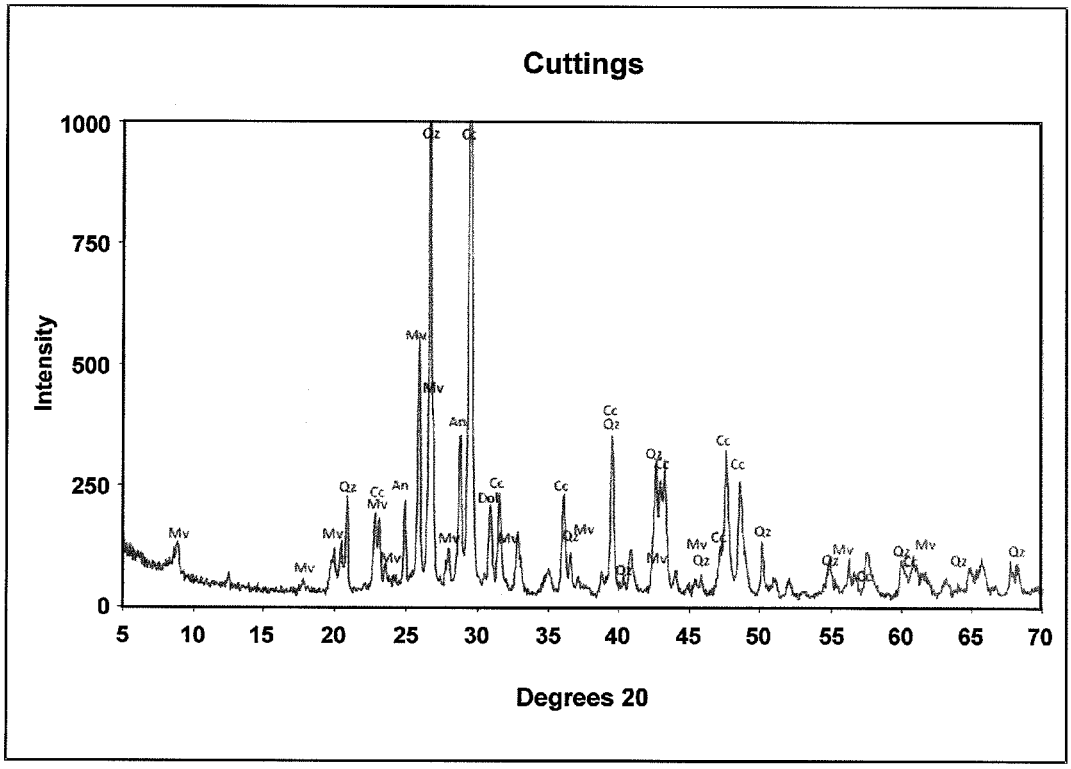
FIG. 4. X-ray diffraction (XRD) powder pattern showing typical mineralogical composition of horizontal drill cuttings. Major components include quartz, calcite, dolomite, muscovite, and anorthite.

A process and associated reagents or binders are disclosed for the conversion of intractable semi-solid, water-bearing and water/oil-bearing drill cuttings to a free-flowing, stabilized drill cutting material (SDC material) that can be beneficially used, after compaction, for engineering construction applications.

The process employs the use of a reagent package, which converts the intractable cuttings to a granular, compactable SDC material, while at the same time meeting environmental requirements for the immobilization of potentially toxic metals and organic contaminants that may be present in the cuttings.

The reagents disclosed herein can be described as being both cementitious and pozzolanic in nature. The component ingredients can be selected from, but are not limited to: Portland cement; lime; lime kiln dust; cement kiln dust; fly ash from pulverized coal combustion; residues from fluidized bed combustors; dry residues from pollution abatement systems; slags from iron ore blast furnaces and non-ferrous smelters; waste glasses; natural pozzolans; and combinations thereof.

Other additives may be incorporated into the reagents for specific requirements and may be selected for enhancement of the immobilization of certain metal and/or organic contaminants. These enhancement additives include, but are not limited to: amorphous carbon, calcined clay, calcium sulfate, and zeolites.

The reagents serve two inter-related functions: first, to act as a binder which cements the fine particles together, thereby reducing the plasticity of the mixture; and second, to immobilize potentially toxic contaminants, such as regulated leachable metals and organics, through chemical complexation and physical encapsulation.

As understood by those skilled in the art, several of the potential reagents or ingredients noted above, such as lime, kiln dusts, and fly ash, may be well suited for the mud drying function; whereas others, such as Portland cement can provide a cementing function; but not necessarily for both in conjunction with immobilizing toxic contaminants. For this purpose, it is advantageous to utilize combinations of materials, such as fly ash or slag derived aluminosilicates in conjunction with an alkaline "activator" such as cement, lime, or kiln dust.

Various fluidized bed combustion (FBC) residues can provide many of these advantages without the need for chemical activators. FBC residues are captured as solid, particulate by-products from the combustion of coal and other fuels on a limestone fluidized bed. This combustion technology produces a unique and complex assemblage of mineralogical components in FBC residues. Some of the components—such as amorphous calcined clays/shales resembling metakaolin ($Al_2Si_2O_7$), iron oxides related to magnetite/ferrite spinel ($Fe_3O_4$) and hematite ($Fe_2O_3$), and amorphous carbon—can be associated with the coal fuel, either as unburned carbon or residual inorganic matter that was inter-bedded with the coal. Other components of the residues—including calcium sulfate as anhydrite ($CaSO_4$), calcium sulfite as hannebachite ($2CaSO_3.H_2O$), calcium oxide resembling quicklime (CaO), Portlandite ($Ca(OH)_2$), and calcite ($CaCO_3$)—are associated with the limestone fluid bed used for capturing gaseous pollutants. It will be appreciated by those skilled in the art that this assemblage contains both internal alkaline activator and a pozzolanic components, and, as a result, is particularly effective for this application without the need for Portland cement or other activators.

In accordance with an important aspect of the invention, the moisture content of the raw drill cuttings is controlled to a predetermined range, for example 10-20%, by a mechanical centrifuge or similar device. In the absence of moisture control, the reagent can be used at higher dosage rates to accommodate higher moisture content drill cuttings. In some jurisdictions, it may be permissible to dry the cuttings naturally by creating windrows.

The dewatered drill cuttings are typically mixed with the reagent using a pug mill or similar robust mixing device designed for continuous operation. Stabilization is typically is very rapid, with solidification occurring within approximately ten seconds from contact of the reagent with the cuttings. Under certain conditions, though less desirable, the mixing can be conducted in a large batch mixing device, such as stationary concrete mixer or mobile mixer truck.

Figure 7:
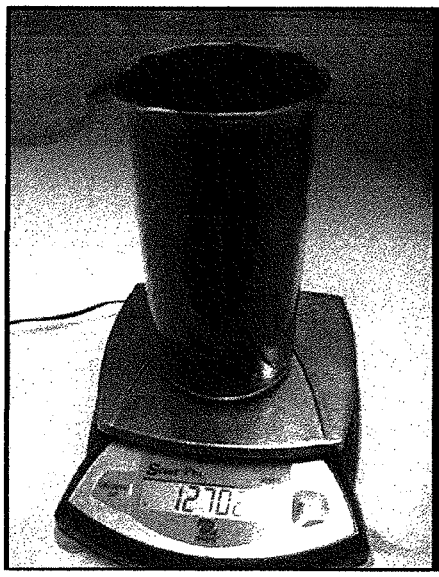
FIG. 7. Bulk density (unit weight) of stabilized, un-compacted SDC Material (79 lb/ft$^3$=1270 g/L), which is comparable with a typical loam soil.
Figure 8:
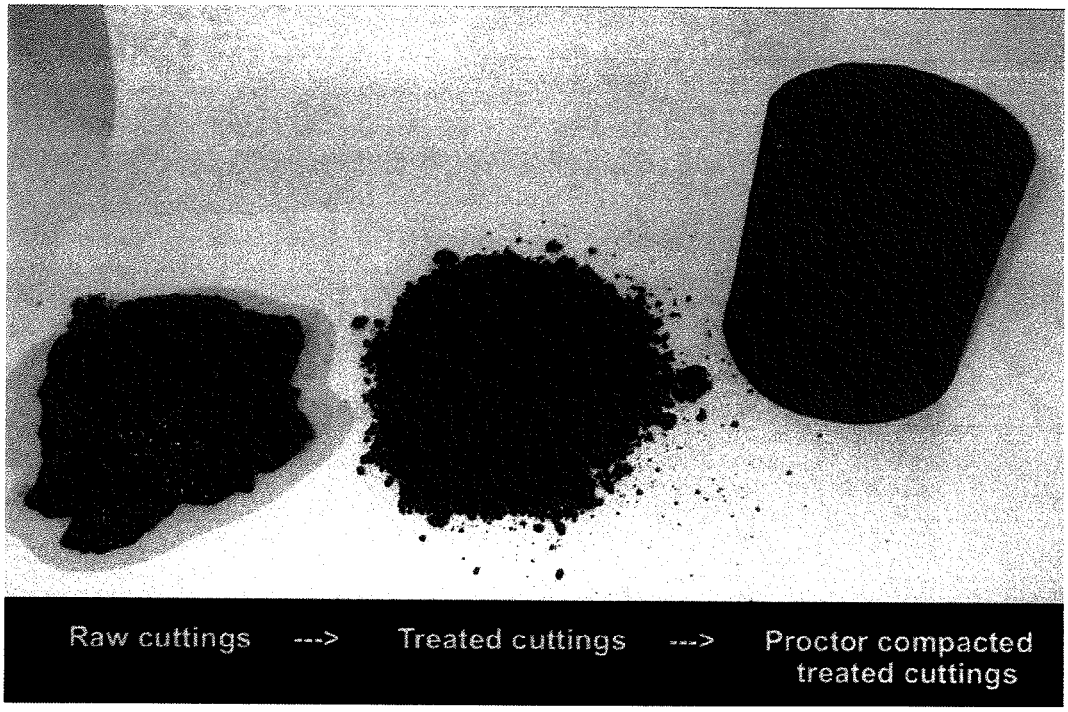
FIG. 8. Conversion of intractable raw drill cuttings to free-flowing granular SDC Material, which is then compacted.

The resulting product from this treatment is a free-flowing, granular SDC material, which typically has a bulk density (unit weight) of approximately 80 lb/ft$^3$ (FIG. 7), comparable with loam-type naturally occurring soils. This granular SDC product has low plasticity and can be readily compacted in the field with typical roller compaction equipment, which can be simulated in the laboratory by the ASTM D-698 Standard Proctor Compaction technique (FIG. 8). According to this method, the moisture and reagent dosage are varied in a controlled way to produce optimum moisture-density suitable for compaction. As noted above, the moisture of the dewatered cuttings is preferably in the range 5-30% and even more preferably in the range 10-20% before treatment with the Reagent.

Figure 5:
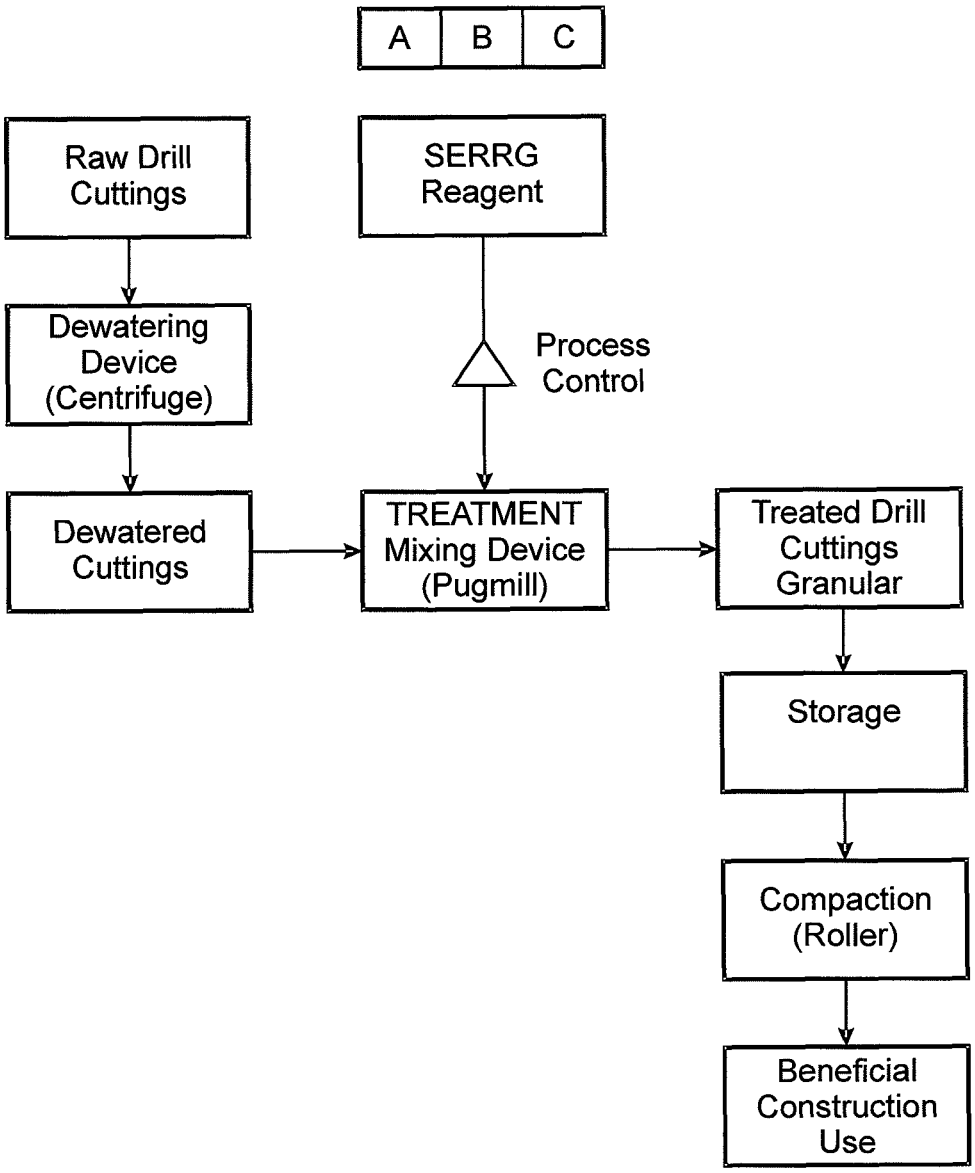
FIG. 5. Diagram showing steps in the conversion process.

An exemplary process for processing the drill cuttings in accordance with the present invention is shown schematically in FIG. 5 and described briefly as follows.

(i) First, the raw drill cuttings are dewatered by a mechanical means, preferably using a centrifuge, or less preferably a filter press or similar device, to a predetermined moisture content, preferably in the range 5% to 30% (w/w) moisture, and even more preferably in the range 10% to 20% (w/w) moisture. In some jurisdictions, it may be feasible to dry the drill cuttings naturally by creating windrows.

(ii) Second, the selected cementitious-pozzolanic reagent or binder is added to the dewatered cuttings at a predetermined dosage rate to solidify the intractable mud and stabilize contaminants against potential release. The dosage rate of the reagent is predetermined by the moisture content of the dewatered drill cuttings and is controlled by a metering device which is synchronized with the flow rate of the process, typically in units such as pounds per hour. This addition is typically conducted volumetrically and may be regulated by a process control device or similar automated system, based on prior calibration in terms of mass flow, typically in pounds per hour.

Figure 6:
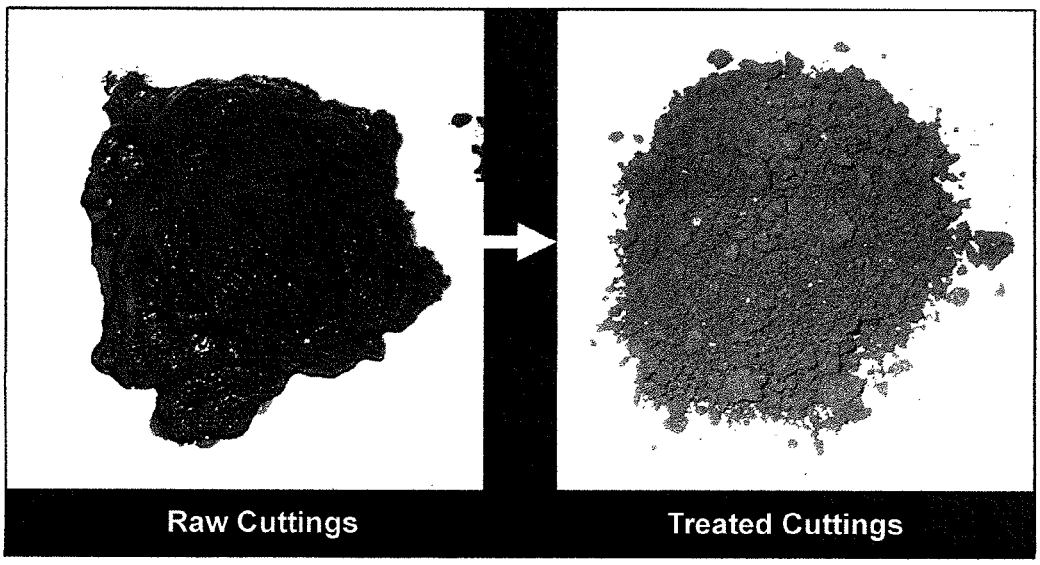
FIG. 6. Conversion of intractable raw drill cuttings to free flowing granular SDC material with Reagent.

(iii) Third, the dewatered cuttings and reagent are thoroughly mixed using a mechanical mixing device, such as a pug mill or similar robust device. This step rapidly converts the intractable, semi-solid cuttings to the free-flowing, granular SDC material which resembles soil in consistency (FIGS. 6 & 7).

(iv) Fourth, the stabilized drill cuttings, now termed SDC Material, are discharged to a suitable receiving vessel, such as a roll off container.

(v) Fifth, the SDC Material is accumulated in a suitable covered storage area prior to beneficial use. Ideally, this storage area could be the site of the next exploration well or any nearby convenient site with good access which could serve as a centralized transfer station.

Figure 9:
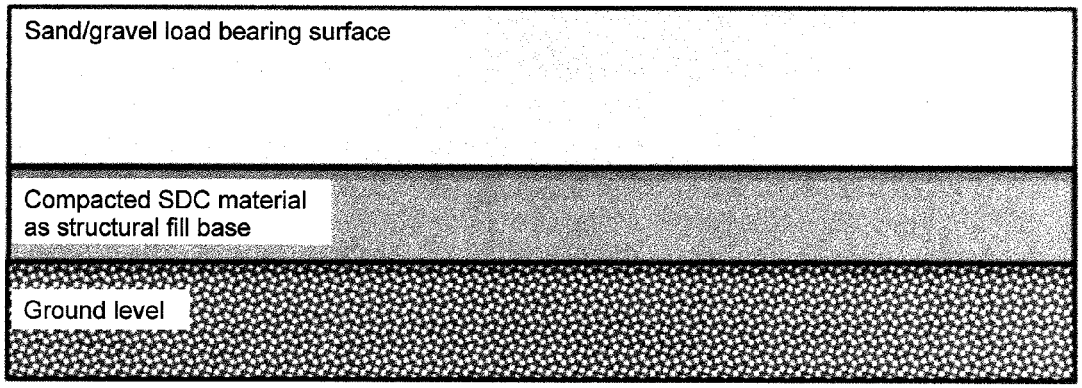
FIG. 9. A cross-sectional view of a typical structural pad showing the various layers involved.

Alternatively, in instances where on-site moisture control is unavailable or otherwise it is not possible to achieve the preferred moisture content for the cuttings, the Reagents can be economically used at elevated concentration to compensate for the excess moisture to form a granular compatible material that can be used, for example, as a structural fill base, as illustrated in FIG. 9 and discussed below.

As mentioned above, an important aspect of the invention, the moisture content of the drill cuttings is controlled to control the cost and the strength of the resulting construction material. The moisture content of the drill cuttings can be measured by a variety of methods in both the process control laboratory and in the field as a part of operations.

These methods include, but are not limited to: (a) nuclear densometer methods according to ASTM D-6938; (b) determining the mass loss on heating the moist cuttings to 110° C., according to the ASTM D 2216 method; (c) determining the density and comparing the value to a predetermined calibration curve relating density to the moisture content; (d) microwave meter; and (e) soil moisture meter.

Applications

There are many potential beneficial applications for the drill cuttings, processed in accordance with the present invention. These applications include various engineering construction applications but are not limited to: structural fill bases for pads at nearby gas exploration well sites; base/subbase for access roads at the well sites; brownfields redevelopment; restoration of abandoned mines to abate acid mine drainage and control subsidence; embankment stabilization and development; structural and flowable fills; and many other potential applications that will be apparent to those familiar with the art. The processed drill cuttings can be transported to and stored in a centralized storage facility for use at a number drilling sites.

In accordance with another important aspect of the invention, the drill cuttings processed in accordance with the present invention require no forming as load bearing structures and may simply used as an underlayment and not as an aggregate, as disclosed in the prior art. A cross-sectional view of a structural pad in accordance with the present invention showing the various construction layers involved is shown schematically in FIG. 9. After general grading of the site, the SDC material is applied and compacted by roller to form a structural fill layer in thicknesses ranging from 6-inches, or less, to 18-inches, or more. Then a layer of sand and gravel is applied and compacted by roller over the SDC material to form a conventional load-bearing, surface layer, which can range from 12-inches to 30-inches, or more.

EXAMPLES

Example 1

Optimization of Reagent Dosage for Optimum Moisture-Density of Compacted SDC Material The standard procedure for evaluation of any type of granular material for use as engineered fill is the Proctor test (ASTM D-698). This test evaluates the relationship between the moisture content of the granular material and its dry density after a standard compaction effort: for a stable engineered fill the compacted granular material needs to be at its maximum density.

Figure 11:
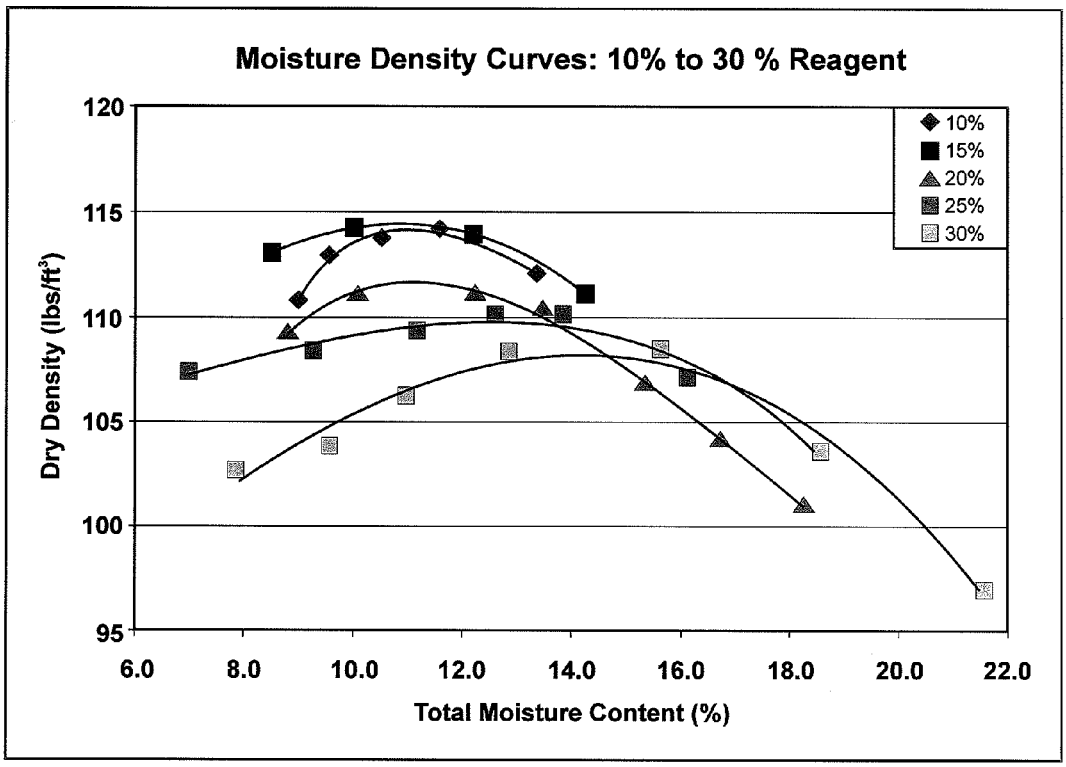
FIG. 11. Examples of Proctor moisture-density curves for SDC Material with Reagent at dosage levels ranging from 10% (w/w) to 30% (w/w).

A series of SDC Material mix designs of uniform composition and initial moisture content were prepared. From this common starting point, a series mixes were compacted by the Proctor method, where the Reagent dosage varied from 10-30% (w/w) of the total SDC Material, as shown in FIGS. 10(*a*)-(*e*). The moisture content of the various mix designs was slowly increased, with dry density values determined as per ASTM D-698 for each step in the process. For each mix, the data in FIGS. 10 (*a*)-(*e*) clearly show an optimum moisture content to achieve maximum compacted density, typically in the range 110-120 lb/ft$^3$, which translates into maximum strength for a given composition, minimum permeability and minimal risk of dimensional changes in service. The Proctor moisture-density curves are compared for the same series of SDC mixes in FIG. 11. This series of experiments show the SDC material to behave in a predictable manner in standard engineered fill evaluation tests.

Example 2

Figure 12:
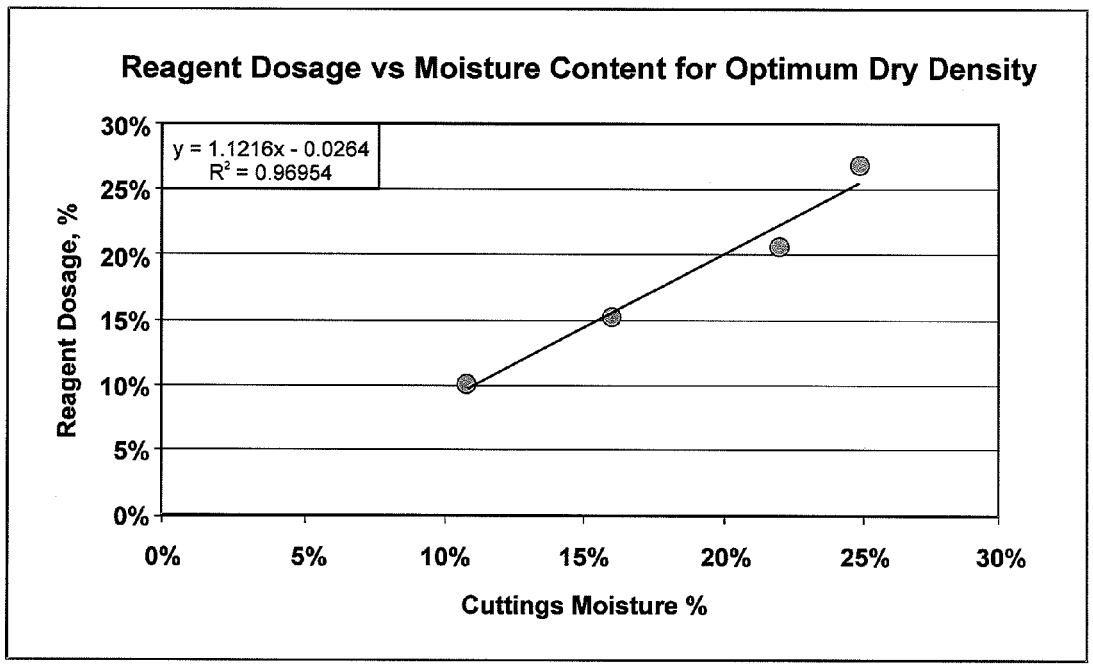
FIG. 12. Prototype process control curve for Reagent addition, as a function of the moisture content of the raw drill cuttings, to achieve optimum density for the treated SDC Material product.

Relationship Between the Moisture Content of the Raw Drill Cuttings and the Reagent Dosage The end use of the SDC Material requires compaction to optimum moisture density conditions as defined in ASTM D-698. In order to facilitate final placement, it is preferred that the treatment of the drill cuttings results in an SDC material at or near the optimum moisture content. The current invention provides a process for the most efficient use of the reagent with the inherently variable nature of the drill cuttings to provide a consistent granular fill product. FIG. 12 shows the relationship between the moisture content of the drill cuttings and the Reagent dosage required to achieve maximum compacted density of the SDC Material. This relationship is the basis for process control in the system.

Example 3

Figure 13:
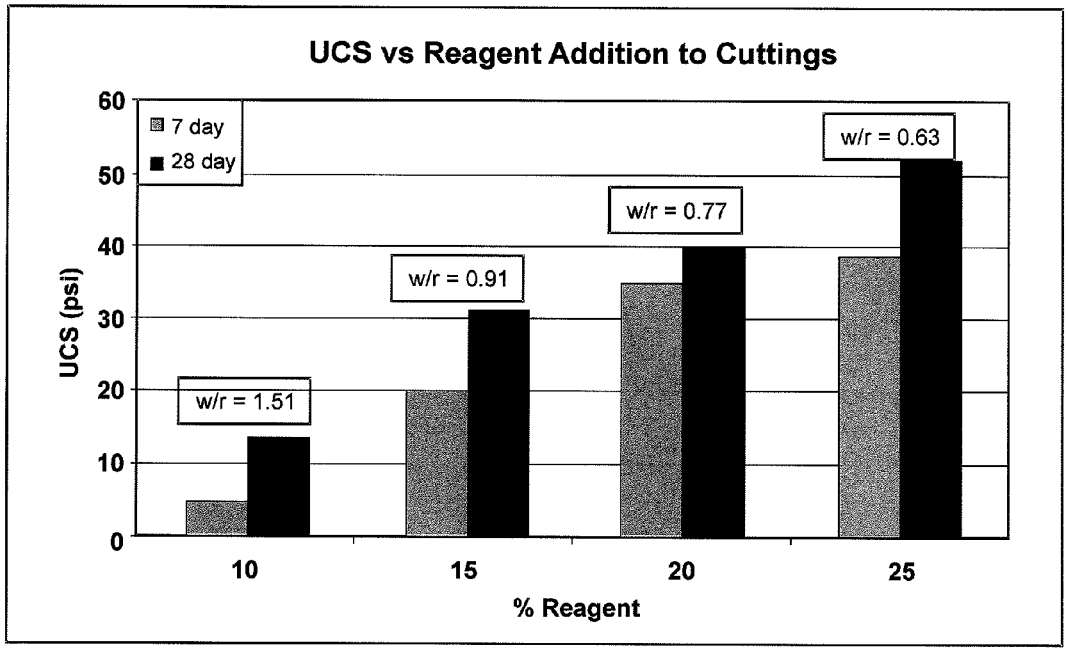
FIG. 13. Unconfined compressive strength (UCS) of compacted SDC Material at different initial moisture contents vs. Reagent dosage.
Figure 14:
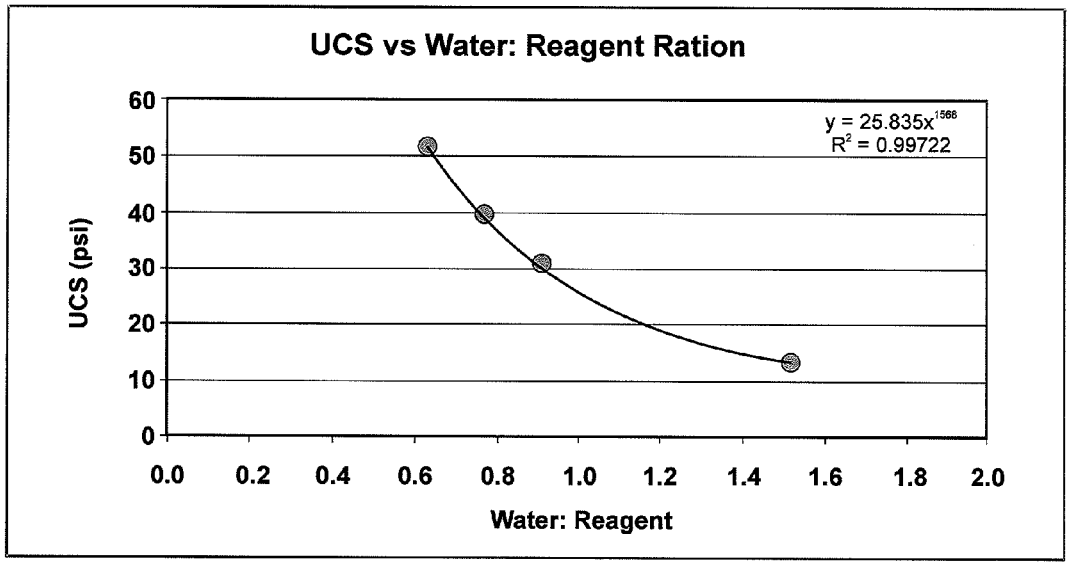
FIG. 14. Relationship between unconfined compressive strength (UCS) of compacted SDC Material and water/reagent ratio.

Relationship Between the Unconfined Compressive Strength for Compacted SDC Mixes and Their Reagent Contents There is a well-defined relationship between the unconfined compressive strength (UCS) for these compacted SDC Material mixes and their Reagent contents (FIG. 13). Further, it has been discovered that this unconfined compressive strength is defined by the inherent water-to-Reagent content of the individual mixes as shown in FIG. 14. It is possible to use this relationship to predict both the required reagent dosage rate and final UCS for a given moisture condition of the initial raw drill cuttings. These data can be used in conjunction with the reagent dosage process in Example 2 to optimize the process for any combination of maximum dry density, moisture content and UCS target values.

The treated granular SDC product can be stored in a manner similar to naturally occurring soil prior to use in construction, ideally protected from the weather. The treated granular product can be compacted at the job site using conventional rollers or similar equipment with appropriate adjustment of moisture content for optimal compacted density.

Example 4

Environmental Stability of SDC Material

In addition to the ability of the current invention to convert the intractable, semi-solid, drill cutting wastes to granular, free-flowing SDC, the inventors have determined that the cementitious-pozzolanic chemistry of the Reagents is effective for immobilizing RCRA and other regulated metal contaminants. The EPA Method 1311: Toxicity Characteristic Leaching Procedure (TCLP) of the SDC material confirms that good immobilization has been achieved by the process (FIG. 15).

Further enhancement with other additives can be customized to treat a wide range of potential contaminants, as required. This enhancement will be utilized with any source of drill cuttings that are identified as containing RCRA regulated metals or organic contaminants.

Obviously, many modifications and variations of the present invention are possible in light of the above teachings. Thus, it is to be understood that within the scope of the appended claims, the invention may be practiced otherwise than as specifically described above.

We claim:

1. A process for treating intractable drill cuttings from gas extraction development wells to form a compactable material for use as a compactable fill base material, the process comprising the steps of:

(a) dewatering the intractable drill cuttings with a mechanical device to a controlled moisture content of 5-30% of the total mixture;

(b) adding one or more reagent to the intractable drill cuttings as a function of the moisture content of the dewatered drill cuttings, wherein the moisture content is based upon the end use of the free flowing material;

(c) mixing the dewatered drill cuttings and the reagent with a mechanical mixing device to convert the drill cuttings to a free flowing compactable material for use as a structural fill material;

(d) disposing said free flowing material to form a fill base; and (e) compacting said fill base to form a compactable structural fill base.

2. A process by which the moisture content of the drill cuttings in claim 1 is controlled by a mechanical centrifuge.

3. A process as recited in claim 1, wherein said one or more reagents are suitable for solidifying and stabilizing the controlled moisture content drill cuttings, selected from the group consisting of Portland cement; quicklime; hydrated lime, lime kiln dust; cement kiln dust; fly ash from coal combustion; residues from fluidized bed combustors; slags from blast furnaces and non-ferrous smelters; waste glasses; natural pozzolans; and combinations thereof.

4. A process as recited in claim 1, wherein said one or more reagents are suitable for solidifying and stabilizing drill cuttings which are not adequately moisture controlled, selected from the group consisting of Portland cement; lime; lime kiln dust; Cement kiln dust; fly ash from coal combustion; residues from fluidized bed combustors; slag from blast furnaces and non-ferrous smelters; waste glass; natural pozzolans; and combinations thereof.

5. A process for converting drill cuttings to a granular compactable material suitable for use in engineering construction applications, the process comprising the steps:

(a) controlling the water content of the drill cuttings to between 5% and 30%; and (b) adding one or more reagents to the drill cuttings at a rate based upon the moisture content of the dewatered drill cuttings to provide a free-flowing mixture in order to form a compactable fill base material; and (c) compacting said fill base to form a compactable structural fill base.

6. The process as recited in claim 5, wherein step (a) comprises:

(a) dewatering the drill cuttings so that the moisture content is between 10% and 20%.

7. The process as recited in claim 5, further comprising step (c) which comprises:

(c) controlling the water/binder ratio of the mixture in order to control the compressive strength of the resulting mixture.

8. A process for converting drill cuttings to a granular compactable material comprising the steps of:

(a) dewatering drill cuttings;

(b) adding a one or more reagents as a function of the moisture content; and (c) mixing the one or more reagents and the drill cuttings to obtain a free-flowing mixture to form a compactable fill base material; and (d) compacting said fill base to form a compactable structural fill base.

9. The process as recited in claim 8 further including step (d):

(d) storing the free flowing mixture in a storage vessel.

10. A process for treating intractable drill cuttings from gas extraction development wells to form a compactable material for use as a compactable fill base material, the process comprising the steps of:

(a) dewatering the intractable drill cuttings to a controlled moisture content of 5-30%;

(b) adding one or more reagents to the intractable drill cuttings as a function of the moisture content of the dewatered drill cuttings; and (c) mixing the dewatered drill cuttings and the one or more reagents with a mechanical mixing device to convert the drill cuttings to a free flowing material for use as a compactable fill material; and (d) compacting said fill base to form a compactable structural fill base.

11. The process as recited in claim 10, wherein step (a) includes dewatering with a mechanical device.

12. The process as recited in claim 10, wherein step (a) includes dewatering with a dewatering agent.

* * * * *